US010655904B2

(12) United States Patent
Aiken et al.

(10) Patent No.: US 10,655,904 B2
(45) Date of Patent: May 19, 2020

(54) MERCHANDISER INCLUDING FRAME HEATERS

(71) Applicant: Hussmann Corporation, Bridgeton, MO (US)

(72) Inventors: Daniel Aiken, Ballwin, MO (US); John M. Rasch, St. Charles, MO (US)

(73) Assignee: Hussmann Corporation, Bridgeton, MO (US)

( * ) Notice: Subject to any disclaimer, the term of this patent is extended or adjusted under 35 U.S.C. 154(b) by 644 days.

(21) Appl. No.: 14/245,475

(22) Filed: Apr. 4, 2014

(65) Prior Publication Data

US 2015/0285551 A1 Oct. 8, 2015

(51) Int. Cl.

| | |
|---|---|
| ***F25D 21/08*** | (2006.01) |
| ***A47F 3/04*** | (2006.01) |
| ***F25D 21/00*** | (2006.01) |
| *F25D 21/04* | (2006.01) |

(52) U.S. Cl.

CPC ..... *F25D 21/006* (2013.01); *A47F 3/0478* (2013.01); *F25D 21/008* (2013.01); *F25D 21/08* (2013.01); *A47F 3/0404* (2013.01); *F25B 2700/02* (2013.01); *F25D 21/04* (2013.01); *F25D 2500/02* (2013.01)

(58) Field of Classification Search

CPC .... F25D 21/006; F25D 21/008; A47F 3/0408; A47F 3/0478

See application file for complete search history.

(56) References Cited

U.S. PATENT DOCUMENTS

| | | | | |
|---|---|---|---|---|
| 3,939,666 | A | 2/1976 | Bashark | |
| 4,127,765 | A * | 11/1978 | Heaney | A47F 3/0434 219/218 |
| 4,548,049 | A | 10/1985 | Rajgopal | |
| 5,899,078 | A | 5/1999 | Mager | |
| 7,240,501 | B2 | 7/2007 | Bunch et al. | |
| 7,905,101 | B2 | 3/2011 | Sunderland et al. | |

(Continued)

FOREIGN PATENT DOCUMENTS

WO 2006093751 A2 9/2006

OTHER PUBLICATIONS

Australian Patent Examination Report No. 1 for Application No. 2014253516 dated Sep. 3, 2015 (3 pages).

(Continued)

*Primary Examiner* — Nelson J Nieves
(74) *Attorney, Agent, or Firm* — Michael Best & Friedrich LLP

(57) ABSTRACT

A refrigerated merchandiser including a case defining a product display area and including a frame having a mullion. The mullion defining an opening to the product display area. A door is coupled and movable relative to the frame over the opening to provide access to the product display area. A refrigeration system is in communication with the product display area to condition the product display area. A first heater is coupled to and routed along the frame and a second heater is coupled to and routed along the frame. The second heater is separate from the first heater. A controller is operatively coupled to the first heater and the second heater and programmed to dependently control the first heater and the second heater relative to each other to remove or inhibit formation of condensation.

20 Claims, 4 Drawing Sheets

(56) References Cited

U.S. PATENT DOCUMENTS

| | | | | |
|---|---|---|---|---|
| 8,250,873 | B2 | 8/2012 | Yoon et al. | |
| 8,434,317 | B2 | 5/2013 | Besore | |
| 8,539,783 | B1 * | 9/2013 | Bunch | A47F 3/0482 62/150 |
| 2002/0125859 | A1 * | 9/2002 | Takeo | B60H 1/00428 320/137 |
| 2005/0229614 | A1 | 10/2005 | Ansted | |
| 2006/0026975 | A1 | 2/2006 | Bunch et al. | |
| 2010/0083672 | A1 | 4/2010 | Yoon et al. | |
| 2012/0067072 | A1 * | 3/2012 | Malwitz | F25D 21/08 62/152 |
| 2014/0069125 | A1 * | 3/2014 | Chikkakalbalu | A47F 3/0408 62/80 |

OTHER PUBLICATIONS

Patent Examination Report No. 2 from IP Australia for Application No. 2014253516 dated Mar. 9, 2016 (3 pages).
New Zealand Patent Office Action for Application No. 702341 dated Jan. 8, 2018 (5 pages).

* cited by examiner

MERCHANDISER INCLUDING FRAME HEATERS

BACKGROUND

The present invention relates to refrigerated merchandisers, and more specifically to anti-sweat control for refrigerated merchandisers.

Existing refrigerated merchandisers generally include a case defining a product display area that supports and/or displays products visible and accessible through an opening in the front of the case. Some refrigerated merchandisers include doors that enclose the product display area of the case. The doors typically include one or more glass panels that allow a consumer to view the products stored inside the case.

Often, condensed moisture accumulates on one or more surfaces of the door, which obscures viewing of the product in the merchandiser. For example, moisture in a relatively warm ambient environment surrounding the merchandiser may condense on the outside surface of the glass door, or on the inside surface when the door is opened. Without heating, the condensation on the outside and inside of the glass door does not clear quickly and obscures the product in the merchandiser. Long periods of obscured product caused by condensation may detrimentally impact sales of the product.

Some doors include resistive or conductive films that are applied to the glass panel to reduce or eliminate condensation and fogging. The resistive film is connected to a power source and applies heat to the glass door via current flow through the coating. Typically, heat applied to the glass door is controlled by a controller based on a duty cycle that varies between an "on" state (i.e. heat applied to the glass door) and an "off" state to regulate the time that heat is applied to the glass door. However, when the glass door is opened during the predetermined time that the duty cycle is in the "off" state, condensation may readily form on the interior and/or exterior of the glass door.

Existing merchandisers also often include a frame heater that is connected to the frame around the doors to heat the frame. Typically, merchandisers include a single, continuous frame heater that extends across the case frame and along the mullions so that heat can be applied to all parts of the frame. While most of the condensation arises at lower areas of the frame (where the air temperature differential between the product display area and surrounding ambient air is highest), an existing frame heater applies the same amount of heat to the entire frame.

SUMMARY

In one construction, the invention provides a refrigerated merchandiser including a case defining a product display area and including a frame having a mullion. The mullion defining an opening to the product display area. A door is coupled and movable relative to the frame over the opening to provide access to the product display area. A refrigeration system is in communication with the product display area to condition the product display area. A first heater is coupled to and routed along the frame and a second heater is coupled to and routed along the frame. The second heater is separate from the first heater. A controller is operatively coupled to the first heater and the second heater and programmed to dependently control the first heater and the second heater relative to each other to remove or inhibit formation of condensation.

In another construction, the invention provides a case defining a product display area and including a frame having a mullion. The mullion defines an opening to the product display area. A door is coupled and movable relative to the frame over the opening to provide access to the product display area. A refrigeration system is in communication with the product display area to condition the product display area. A first heater is coupled to and routed along the frame. The first heater has a first wattage output. A second heater is coupled to and routed along the frame. The second heater is separate from the first heater and has a second wattage output different from the first wattage output. A controller is operatively coupled to the first heater and the second heater and programmed to control the first heater and the second heater to remove or inhibit formation of condensation.

In another construction, the invention provides a method of operating a refrigerated merchandiser including a case defining a product display area and having a frame with a first heater and a second heater routed along the frame, and a door providing access to the product display area. The method includes sensing a parameter of an ambient environment adjacent the case and delivering a signal indicative of the sensed parameter to a controller. The method also includes selectively activating both the first heater and the second heater via the controller in response to the sensed parameter. The first heater has a first wattage output and the second heater has a second wattage output different from the first wattage output. The method also includes removing or inhibiting formation of condensation.

Other aspects of the invention will become apparent by consideration of the detailed description and accompanying drawings.

Before any constructions of the invention are explained in detail, it is to be understood that the invention is not limited in its application to the details of construction and the arrangement of components set forth in the following description or illustrated in the following drawings. The invention is capable of other constructions and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

DETAILED DESCRIPTION

Figure 1:
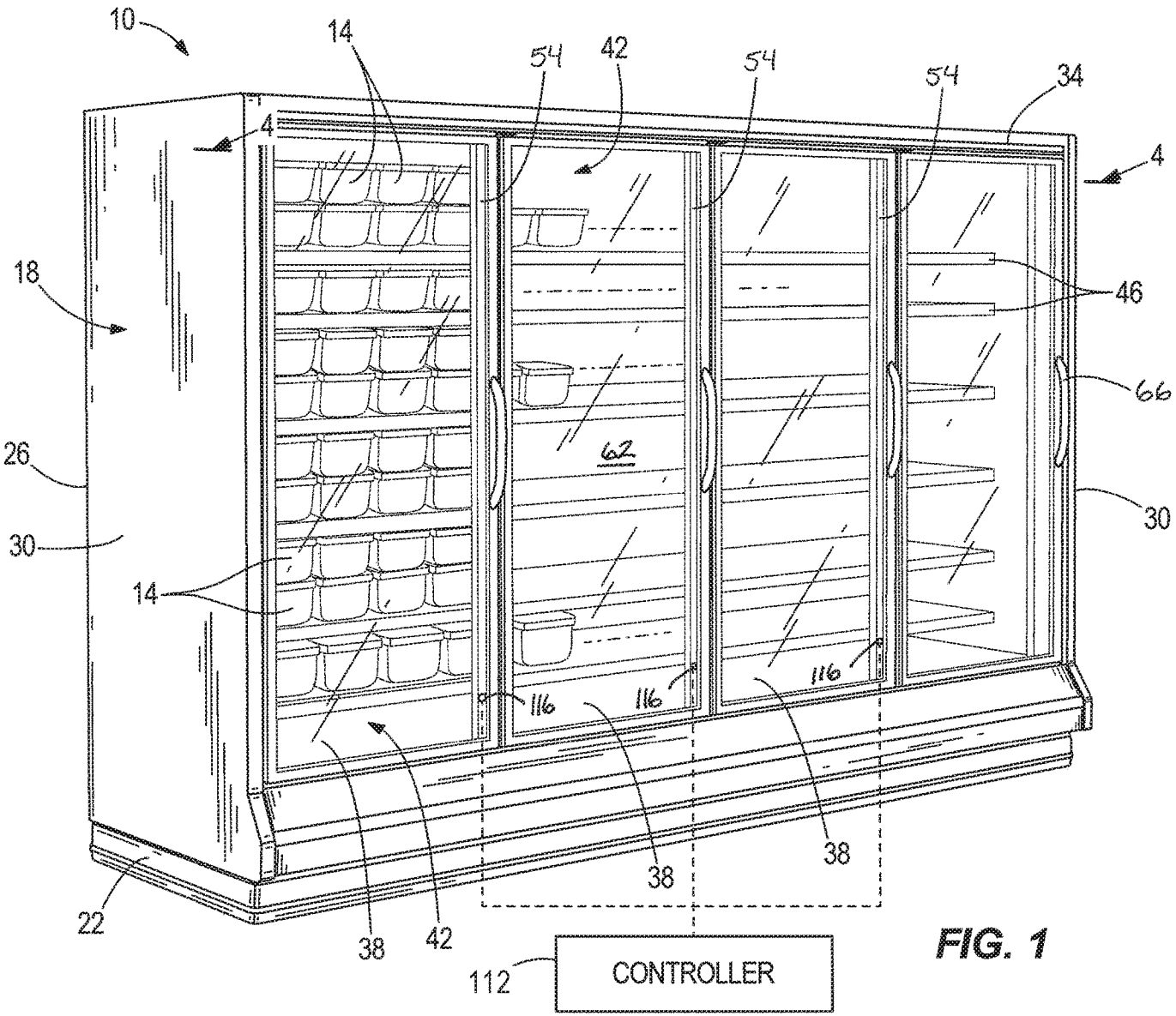
FIG. 1 is a front perspective view of a refrigerated merchandisers embodying the present invention, including a case having at least one door and a control system.
Figure 2:
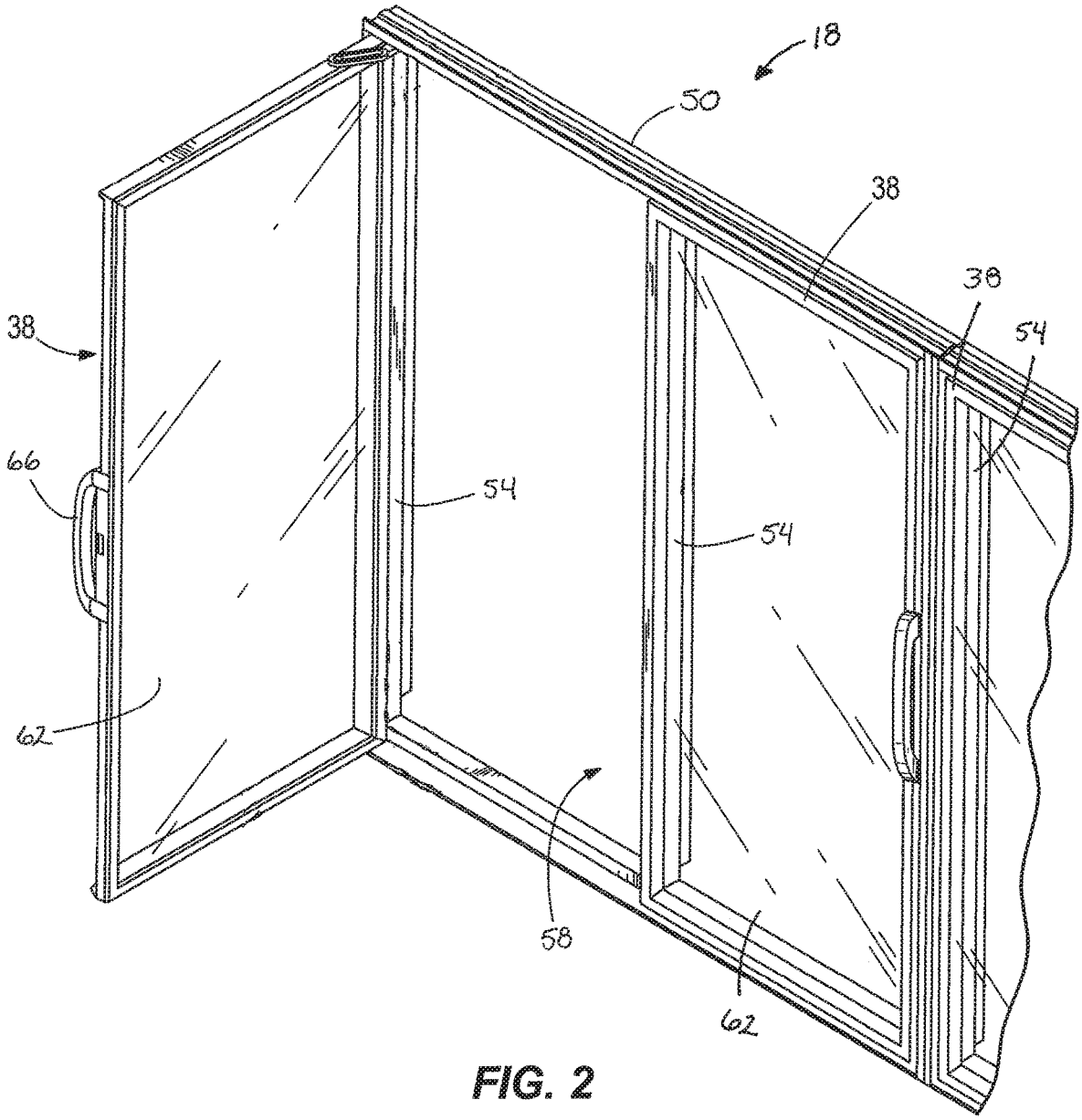
FIG. 2 is a perspective view of the at least one door and a casing of the refrigerated merchandiser of FIG. 1.
Figure 3:
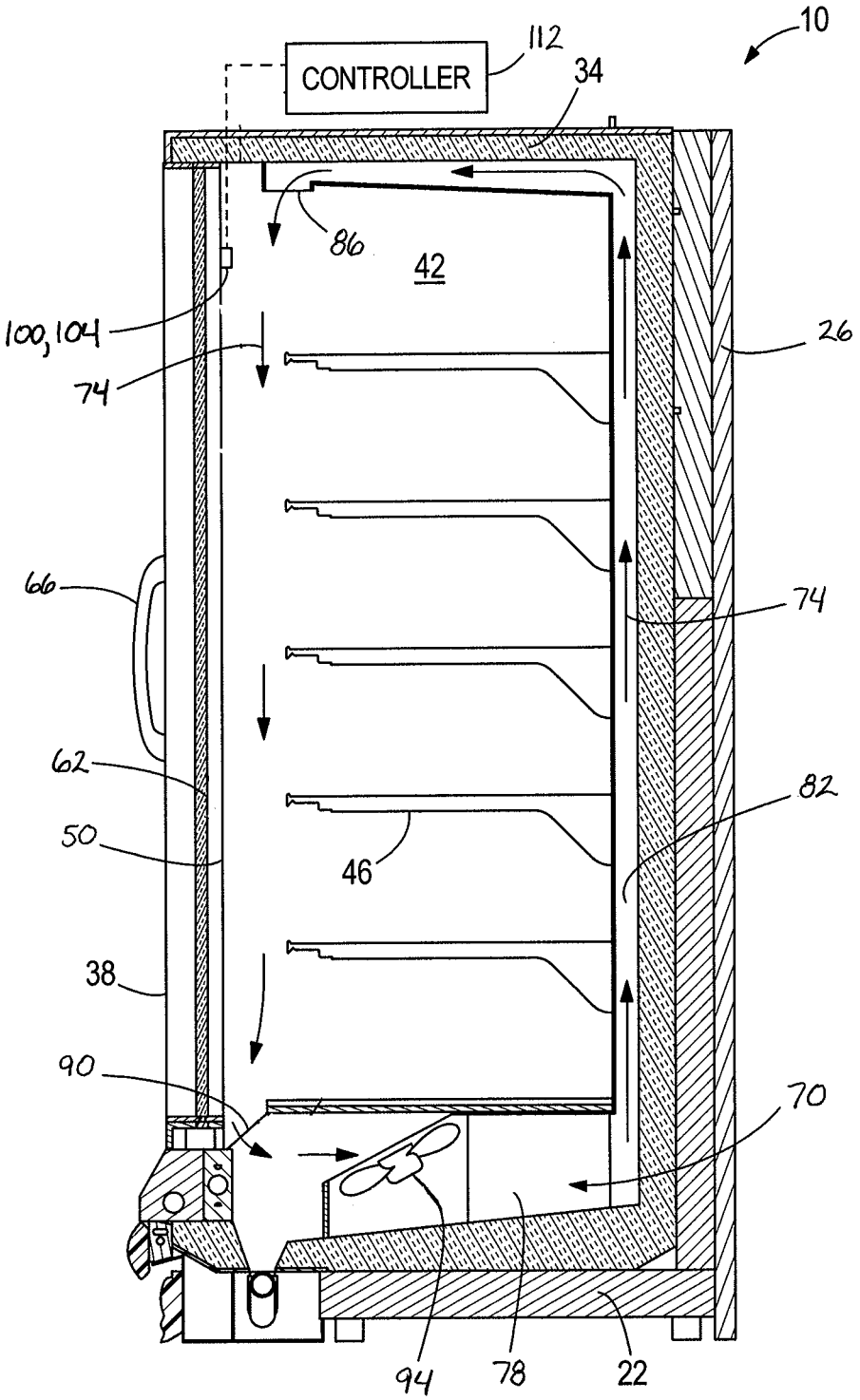
FIG. 3 is a schematic cross-section of one of the refrigerated merchandisers of FIG. 1.

FIGS. 1-3 illustrate an exemplary a refrigerated merchandiser 10 that may be located in a supermarket or a convenience store (not shown) for presenting fresh food, beverages, and other product 14 to consumers. As shown, the merchandiser 10 includes a case 18 that has a base 22, a rear wall 26, side walls 30, a canopy 34, and doors 38 that are coupled to the case 18. The area at least partially enclosed by the base 22, rear wall 26, side walls 30, and the canopy 34 defines a product display area 38 that supports the product 14 in the case 18. The product 14 is displayed on racks or shelves 46 extending forwardly from the rear wall 26, and is accessible by consumers through the doors 38 adjacent the front of the case 18.

Figure 4:
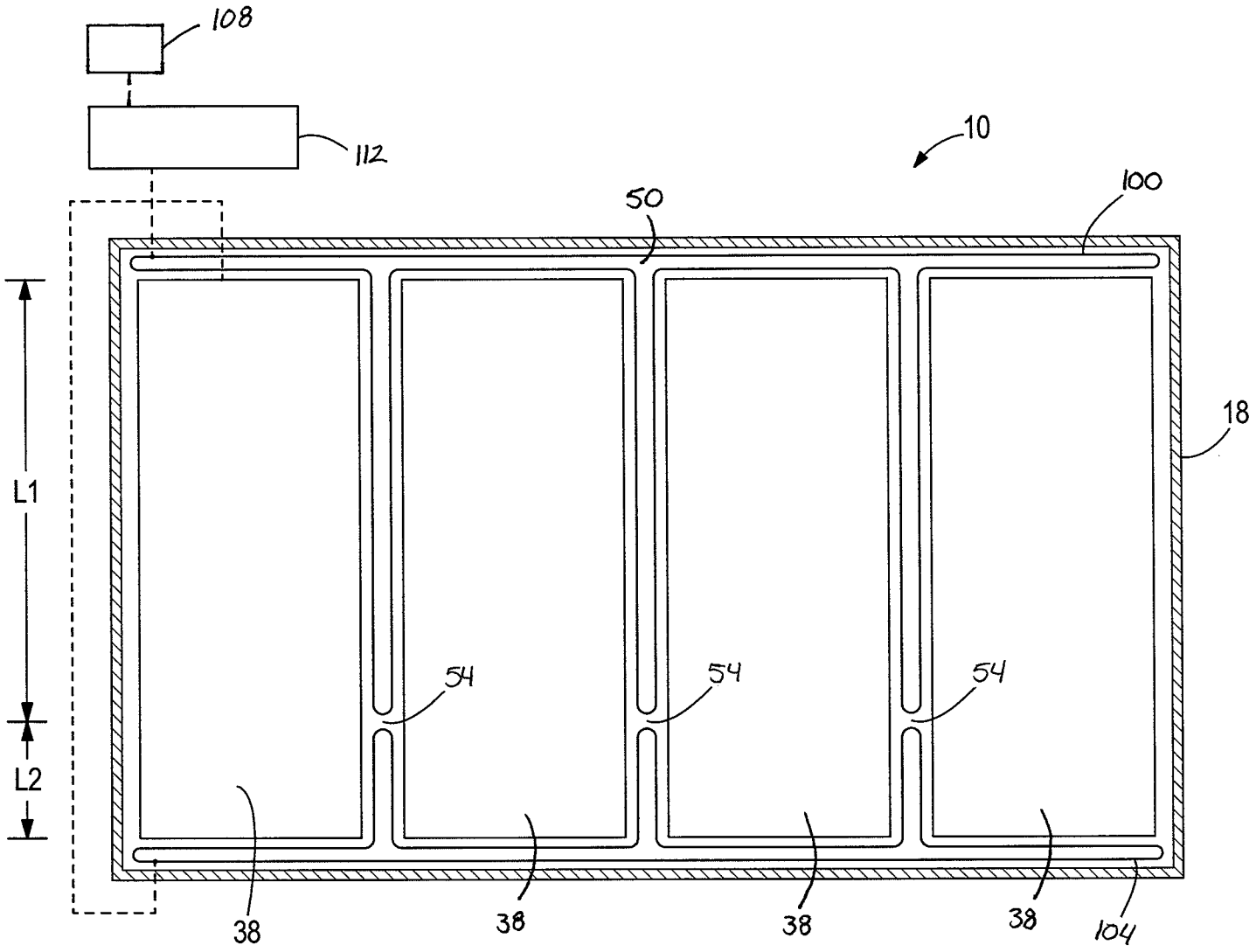
FIG. 4 is a schematic cross-section of one of the refrigerated merchandisers of FIG. 1 along 4-4.

With reference to FIGS. 2 and 4, the case 18 also includes a casing or frame 50 located adjacent a front of the merchandiser 10 to pivotally support the doors 38. In particular, the frame 50 includes vertical mullions 54 that define customer access openings 58 and that support the doors 38 over the openings 58. The openings 58 provide access to the product 14 stored in the product display area 42. The mullions 54 are structural members of the frame 50 spaced horizontally along the case 18. Referring to FIG. 2, each door 38 includes glass panel 62 that has one or more glass panes so that product 14 can be viewed from outside the case 18. A handle 66 is coupled to each door 38 to facilitate opening and closing the door 38.

Referring to FIG. 3, at least a portion of a refrigeration system 70 is in communication with case 18 to condition the product display area 42 via heat exchange relationship between a refrigerant flowing through the refrigeration system 70 and an airflow (denoted by arrows 74) that is directed toward the product display area 42. More specifically, the refrigeration system 70 includes an evaporator 78 that is coupled to the case 18 within an air passageway 82, a refrigerant driving device (e.g., a compressor or a pump—(not shown)), and a heat rejection heat exchanger (not shown). Operation of the refrigeration system 70 is well known and will not be discussed in detail.

The airflow 74 is refrigerated or cooled by heat exchange with refrigerant in the evaporator 78. The refrigerated airflow 74 is directed into the product display area 42 through an air outlet 86 to condition the product display area 42 within a predetermined temperature range (e.g., 33-41 degrees Fahrenheit, approximately 32 degrees or below, etc.). Some air in the product display area 42 is drawn into the air passageway 82 through an air inlet 90 via a fan 94 that is located upstream of the evaporator 78.

Because the product display area 42 is maintained within a temperature range that is relatively cold when compared to the ambient environment surrounding the merchandiser, condensation can form on one or more surfaces of the frame 50 (e.g., on the mullions 54), one or more surfaces of the glass panel 62, or both, when the temperature of the surface(s) falls below a threshold dew point temperature (i.e. based on the relative humidity of the ambient environment). Condensation is a result of a combination of surface temperature and moisture in the surrounding air. For example, condensation can form on one or more interior or exterior surfaces the frame 50, the mullions 54, and/or the glass panel 62 after the door 38 has been opened due to exposure of the relatively cold interior case structure to warm ambient conditions.

With reference to FIGS. 1 and 4, the illustrated merchandiser 10 includes a door heater 96 that is coupled to the glass panel 62 and first and second frame heaters 100, 104 that are coupled to the frame 50 to inhibit or limit or remove condensation and fogging on the door 38 and the frame 50, including in some circumstances surrounding case structure. The door heater 96 includes a conductive layer or coating or film (referred to as "film" for purposes of description) that is affixed or applied on one or more surfaces of the glass panel 62. The film is electrically connected to a power source 108. An insulative film (e.g., dielectric coating—not shown) can be applied over the film to minimize the possibility of electrical shock.

FIG. 4 shows that the first frame heater 100 is coupled to the power source 108 via an electrical connection (not shown), and is routed along and across a top of the frame 50 and downward a short distance along the mullions 54. Although not shown, the first frame heater 100 also can be routed along the end mullions 54 in a similar manner. The illustrated first frame heater 100 defines a continuous loop that is routed along the top of the frame 50 and along the mullions 54 and that terminates at the electrical connections. The first frame heater 100 extends a first distance L1 downward along the mullions 54. For example, the distance L1 can be approximately 75-95% of the entire length of the mullion 54.

With continued reference to FIG. 4, the second frame heater 104 is coupled to the power source 108 via an electrical connection (not shown), and is routed along and across a bottom of the frame 50 and upward a short distance along the mullions 54. As shown, the second frame heater 104 defines a continuous loop that is routed along the bottom of the frame 50 and along the mullions 54 and that terminates at the electrical connections. The second frame heater 104 extends a second distance L2 upward along the mullions 54 and is disposed in close proximity to section of the first frame heater 100 that is routed downward along the mullion 54. The illustrated second distance L2 is shorter than the first distance L1. The distance L2 can be approximately 5-25% of the entire length of the mullion 54. For example, the distance L2 can be approximately 6-12 inches and the distance L1 can be substantially the remaining length of the mullion 54. Other relative distances for the first and second heaters 100, 104 are also possible.

The first frame heater 100 defines a relatively low wattage heating element that has a first wattage output value, and the second frame heater 104 defines a higher wattage heating element that has a second wattage output value. For example, the first frame heater 100 can have a wattage output value of approximately 0.1-4 Watts/foot, and the second frame heater 104 can have a wattage output value of approximately 4.5-7 Watts/foot. In one exemplary construction of the merchandiser 10, the first frame heater 100 has an output value of approximately 3 Watts/foot, and the second frame heater 104 has an output value of approximately 5 Watts/foot. Other heater output values are also possible.

FIG. 4 shows that a controller 112 (e.g., a micro-controller that is part of a larger control system for the merchandiser 10 or separate from such a control system) is coupled to the merchandiser 10. As illustrated, the controller 112 is in electrical communication with the door heater 96, the first and second frame heaters 100, 104, and the power source 108 to provide power to and control of the heaters 96, 100, 104. The controller 112 can be attached to the merchandiser 10 in any suitable location (e.g., the base 22, on the canopy 34, etc.), or located remote from the merchandiser 10.

The controller 112 regulates heat applied to the door via the door heater 96 independent from heat that is applied to the frame 50 via the first and second heaters 100, 104. For example, the controller 112 can energize (e.g., turn "on" or activate) and de-energize (e.g., turn "off" or deactivate) one or more of the door heater 96 and the frame heaters 100, 104 based on ambient conditions in the environment surrounding the merchandiser 10. A sensor 116 can be coupled to the merchandiser 10 to sense or detect a parameter of the surrounding environment (e.g., one or more ambient conditions such as dew point, relative humidity, etc.) and to transmit a signal to the controller 112 to control the heaters 96, 100, 104. As illustrated in FIG. 1, three sensors 116 are coupled to the mullions 54 and are positioned adjacent the openings 58 to detect an ambient parameter value and to communicate the ambient parameter value to the controller 112. As will be appreciated, one or more sensors 116 can be attached to other areas of the merchandiser 10 or located remote from the merchandiser 10 to sense ambient conditions surrounding the merchandiser 10.

In general, the sensors 116 are defined as environmental sensors, and can include a temperature sensing element and/or a humidity sensing element (not shown) to detect a temperature and humidity (i.e. exemplary ambient parameters) of the environment surrounding the merchandiser 10. The sensors 116 may sense other ambient parameters. The ambient parameter(s) can be sensed by the sensor 116 at predetermined time intervals (e.g., 30 seconds, one minute, two minutes, etc.), continuously, or at arbitrary times.

In an exemplary embodiment, the controller 112 communicates with the sensors 116 to determine a duty cycle or pulse width modulation period to regulate heat applied by the door heater 96, and a separate duty cycle for the frame heaters 100, 104 based on the ambient parameter(s) sensed by the sensors 116. For example the door heat duty cycle and the frame heat duty cycle may be synchronous or asynchronous. Also, the duty cycles may overlap such that the door heater 96 is activated before or after the frame heaters 100, 104 are activated, or the duty cycles may be in opposite states in which the door heater is activated or deactivated and the frame heaters are deactivated or activated. In addition, each door heater 96 can have a separate duty cycle to regulate heat on the corresponding door 38 independent of other doors 38.

The illustrated frame heaters 100, 104 are dependently controlled such that both heaters 100, 104 are activated or deactivated at the same time. That is, the duty cycle for the first frame heater 100 is the same as the duty cycle for the second frame heater 104. In some constructions, the frame heaters 100, 104 can be controlled in response to activation and deactivation of one or more components (e.g., fans—not shown) of the refrigeration system 70 in lieu of the controller 112. For example, the heaters 100, 104 may be controlled based on a circuit breaker or switch connected to the fans. In general, the heaters 100, 104 controlled by a circuit (e.g., including the controller 112, the fans and circuit breaker(s), etc.) that is separate from the circuit containing the door heater 96.

The heaters 100, 104 are activated based on the duty cycle to heat the frame 50 along the top and bottom of the case 18, and along the mullions 54 (and in some constructions along the edges of the case 18) to reduce, eliminate, or inhibit condensation and/or fogging on the case 18. In some constructions, the heat applied by the heaters 100, 104 is adequate to inhibit or reduce condensation on the doors 38.

The duty cycle for the heaters 100, 104 repeats over a period of time and includes a first time interval T1 that the heaters 100, 104 are activated and a second time interval T2 that the heaters are deactivated. Generally, the heaters 100, 104 are activated and deactivated several times during one condensation clearing interval. The length of time for one duty cycle can be preset or determined by the controller 112, or by other features of the merchandiser 10 (e.g., door position sensors). By way of example, the duty cycle can repeat over a predetermined time period (e.g., 1 minute, 10 minutes, 15 minutes, etc.) or the duty cycle can repeat over an arbitrary time interval (e.g., defined by the door 38 being opened and later closed).

In addition, the controller 112 determines the first time interval (i.e. the time that the heaters 100, 104 are activated) and the second time interval (i.e. the time that the heaters 100, 104 are deactivated) based on the ambient parameter sensed by the sensor 116. For example, when the relative humidity or dew point is relatively high (e.g., dew points above approximately 40 degrees Fahrenheit), the time that the heaters 100, 104 are activated during the duty cycle will be longer than the time that the heaters 100, 104 are deactivated during the duty cycle. When the relative humidity or dew point is relatively low (e.g., dew points below approximately 40 degrees Fahrenheit), the time that the heaters 100, 104 are activated during the duty cycle will be shorter than the time that the heaters 100, 104 are deactivated during the duty cycle. In some constructions, the frame heaters 100, 104 may be continuously activated at a low power state and, when it is desired to remove or inhibit condensation or fog, varied to a higher power state.

Activation and deactivation of the heaters 100, 104 for the respective first and second time intervals continue until the time period for cycling the heaters 100, 104 has expired (or when it has been determined that condensation has been removed or that condensation-forming conditions are no longer present). The duty cycle is defined by the proportion of the time that the heaters 100, 104 are activated relative to the time that the heaters 100, 104 are deactivated. In other words, the duty cycle can be defined as the ratio of T1:T2.

Table 1, provided below, illustrates exemplary duty cycles for the merchandiser 10 when the temperature surrounding the merchandiser 10 is approximately 55 degrees Fahrenheit. Although specific dew point temperatures are illustrated, the respective duty cycles can be implemented at other dew point temperatures. The duty cycles are defined based on the dew point temperature setpoints shown in Table 1 in view of the ambient temperature. That is, for a given ambient temperature, the dew point temperature setpoint defines the amount of time within the duty cycle that the heaters 100, 104 should be activated to inhibit or clear condensation. In this manner, the ambient temperature and the dew point of the ambient environment, which can be sensed by the sensor 116, define an ambient parameter value for the examples discussed and illustrated below.

As shown in Table 1, when the ambient temperature is 55 degrees Fahrenheit and the dew point temperature is approximately 47.5 degrees Fahrenheit (e.g., a first ambient parameter value), the duty cycle for the frame heaters 100, 104 is 6:1 (i.e. approximately a 86% duty cycle). For example, with this duty cycle, the heaters 100, 104 are activated for six seconds (T1) and deactivated for one second (T2).

| 55° F. Ambient Temperature | |
|---|---|
| Heater Duty Cycle (Seconds) | Dew Point Temperature (° F.) |
| Full On | >50.0 |
| 6:1 | 47.5 |
| 5:2 | 45.0 |
| 4:3 | 42.5 |
| 3:4 | 40.0 |
| 2:5 | 37.5 |
| 1:6 | 35.0 |
| Full Off | <35.0 |

As another example, again referring to Table 1, when the ambient temperature is 55 degrees Fahrenheit and the dew point temperature is approximately 40 degrees Fahrenheit (e.g., a second ambient parameter value), the duty cycle for the frame heaters 100, 104 is 3:4. With this duty cycle, the heaters 100, 104 are activated for three seconds (T2) and deactivated for four seconds (T2). Other duty cycles, including the duty cycle ratios illustrated in Table 1 and duty cycles that are defined by other first and second time intervals T1, T2 (at the same or different dew points) are possible. At dew point temperatures at approximately 50 degrees Fahrenheit or higher (e.g., a third ambient parameter value), the heaters 100, 104 are always on for the entire duty cycle. At dew point temperatures below 35 degrees Fahrenheit (e.g., a fourth ambient parameter value), the heaters 100, 104 are kept off for the entire duty cycle because no condensation forms at this dew point temperature when the ambient temperature is approximately 55 degrees Fahrenheit.

Table 2, provided below, illustrates exemplary duty cycles for the merchandiser 10 when the temperature surrounding the merchandiser 10 is approximately 70 degrees Fahrenheit. As discussed with regard to Table 1, the duty cycles are defined based on the dew point temperature setpoints shown in Table 2 in view of the ambient temperature. That is, for a given ambient temperature, the dew point temperature setpoint defines the amount of time within the duty cycle that the heaters 100, 104 should be activated to inhibit or clear condensation. In this manner, the ambient temperature and the dew point of the ambient environment, which can be sensed by the sensor 116, define an ambient parameter value for the examples discussed and illustrated below.

As shown in Table 2, when the ambient temperature is 70 degrees Fahrenheit and the dew point temperature is approximately 53.3 degrees Fahrenheit (e.g., a fifth ambient parameter value), the duty cycle for the frame heaters 100, 104 is 6:1. For example, with this duty cycle, the heaters 100, 104 are activated for six seconds (T1) and deactivated for one second (T2).

| 75° F. Ambient Temperature | |
|---|---|
| Heater Duty Cycle (Seconds) | Dew Point Temperature (° F.) |
| Full On | >55.0 |
| 6:1 | 53.3 |
| 5:2 | 51.7 |
| 4:3 | 50.0 |
| 3:4 | 48.3 |
| 2:5 | 46.7 |
| 1:6 | 45.0 |
| Full Off | <45.0 |

As another example, again referring to Table 2, when the ambient temperature is 70 degrees Fahrenheit and the dew point temperature is approximately 48.3 degrees Fahrenheit (e.g., a sixth ambient parameter value), the duty cycle for the frame heaters 100, 104 is 3:4. With this duty cycle, the heaters 100, 104 are activated for three seconds (T1) and deactivated for four seconds (T2). Other duty cycles, including the duty cycle ratios illustrated in Table 1 and duty cycles (at the same or different dew points) that are defined by other first and second time intervals T1, T2 are possible. At dew point temperatures at approximately 55 degrees Fahrenheit or higher (e.g., a seventh ambient parameter value), the heaters 100, 104 are always on for the entire duty cycle. At dew point temperatures below approximately 45 degrees Fahrenheit (e.g., an eighth ambient parameter value), the heaters 100, 104 are kept off for the entire duty cycle because no condensation forms below this dew point temperature when the ambient temperature is approximately 70 degrees Fahrenheit.

In general, the duty cycle for the heaters 100, 104 are repeated until the duty cycle is terminated (e.g., based on expiry of the predetermined time period, sensed conditions of the merchandiser 10, etc.). The controller 112, or another mechanism that controls the heaters 100, 104, implements the duty cycle based on the sensed ambient parameter (e.g., one or more of relative humidity, ambient temperature, and dew point temperature) detected by the sensor 116. In addition, although Tables 1 and 2 are described in detail with regard to control of the heaters 100, 104, it will be appreciated that a similar duty cycle strategy can be employed for the door heaters 96.

The controller 112 is programmed to determine a first duty cycle based on a first ambient parameter value (e.g., one or both of ambient temperature and dew point temperature) and to control the heaters 100, 104 based on the first duty cycle. A second, different duty cycle is determined by the controller 112 based on variations in the ambient parameter value (i.e. a second ambient parameter value). As such, the heaters 100, 104 can be dynamically controlled based on the ambient conditions surrounding the merchandiser 10 so that the heaters 100, 104 are activated for the shortest amount of time needed to ensure formation of condensation has been reduced or inhibited.

The illustrated heaters 100, 104 are dependently controlled so that the heaters 100, 104 are activated and deactivated at the same time. Also, more heat is applied to the frame 50 by the second frame heater 104 as compared to the heat applied by the first frame heater 100 because the first frame heater 100 has a lower wattage value than the second frame heater 104. That is, the heaters 100, 104 are activated at the same time and, as such, energy use by the first heater 100 is less than the energy use by the second heater 104. In this manner, a larger amount or concentration of heat is applied by the second frame heater 104 to the frame 50 along the bottom of the case 18 and the lower area of the mullions 54 because condensation tends to form in lower areas of the merchandiser 10. The lower amount of heat applied by the first frame heater 100 to the frame 50 is sufficient to inhibit or remove condensation that may form along a substantial length of the mullion 54 or along the top of the case 18 (or both). The heaters 100, 104 cooperate with each other to ensure that condensation can be quickly removed or prevented entirely.

The duty cycle for the heaters 100, 104 is selected by taking into account the ambient parameter being measured and the amount of heat needed to remove or inhibit condensation. Although the illustrated heaters 100, 104 are described in detail as dependently-controlled, the heaters 100, 104 can be independently controlled. It should be understood that the illustrated duty cycles are merely exemplary and that other duty cycles (e.g., defined by different ratios of time or percentages of time) are possible.

Various features and advantages of the invention are set forth in the following claims.

The invention claimed is:

1. A refrigerated merchandiser comprising:

a case defining a product display area and including a frame having a mullion, the mullion defining an opening to the product display area;

a door coupled and movable relative to the frame over the opening to provide access to the product display area;

a refrigeration system in communication with the product display area to condition the product display area;

a first heater coupled to and routed along the frame;

a second heater coupled to and routed along the frame, the second heater separate from the first heater; and a controller operatively coupled to the first heater and the second heater and programmed to dependently control the first heater and the second heater relative to each other to have a duty cycle that is the same for the first heater and the second heater so that the first heater and the second heater are activated and deactivated at the same time to remove or inhibit formation of condensation.

2. The refrigerated merchandiser of claim 1, further comprising a sensor in communication with an ambient environment adjacent the merchandiser to sense a parameter of the ambient environment, wherein the controller is programmed to determine the duty cycle having an "on" state and an "off" state based on the sensed ambient parameter.

3. The refrigerated merchandiser of claim 2, wherein the duty cycle is a first duty cycle, wherein the controller is programmed to determine the first duty cycle based on a first ambient parameter value, and to determine a second duty cycle based on a second ambient parameter value, and wherein the second duty cycle is different from the first duty cycle.

4. The refrigerated merchandiser of claim 3, wherein at least one of the first duty cycle and the second duty cycle is defined such that the first heater and the second heater are in the "on" state for a first predetermined time, and in the "off" state for a second predetermined time that is shorter than the first predetermined time.

5. The refrigerated merchandiser of claim 3, wherein at least one of the first duty cycle and the second duty cycle is defined such that the first heater and the second heater are in the "on" state for a first predetermined time, and in the "off" state for a second predetermined time that is longer than the first predetermined time.

6. The refrigerated merchandiser of claim 3, wherein the first and second detected parameter values are indicative of at least one of a relative humidity and a dew point associated with the ambient environment.

7. The refrigerated merchandiser of claim 1, wherein the first heater extends along a top of the frame and a first distance along the mullion, and wherein the second heater extends along a bottom of the frame and a second distance along the mullion.

8. The refrigerated merchandiser of claim 7, wherein the second distance is shorter than the first distance.

9. The refrigerated merchandiser of claim 1, further comprising a third heater coupled to the door.

10. The refrigerated merchandiser of claim 9, wherein the controller is programmed to control the third heater independent from the first heater and the second heater.

11. A refrigerated merchandiser comprising:

a case defining a product display area and including a frame having a mullion, the mullion defining an opening to the product display area;

a door coupled and movable relative to the frame over the opening to provide access to the product display area;

a refrigeration system in communication with the product display area to condition the product display area;

a first heater coupled to and routed along the frame, the first heater having a first wattage output;

a second heater coupled to and routed along the frame, the second heater separate from the first heater and having a second wattage output different from the first wattage output; and a controller operatively coupled to the first heater and the second heater and programmed to dependently control the first heater and the second heater to remove or inhibit formation of condensation so that the first heater and the second heater are activated at the same time and deactivated at the same time.

12. The refrigerated merchandiser of claim 11, wherein the second wattage output is lower than the first wattage output.

13. The refrigerated merchandiser of claim 11, wherein the first heater extends along a top of the frame and a first distance along the mullion, and wherein the second heater extends along a bottom of the frame and a second distance along the mullion.

14. The refrigerated merchandiser of claim 13, wherein the second distance is shorter than the first distance.

15. The refrigerated merchandiser of claim 11, further comprising a sensor in communication with an ambient environment adjacent the merchandiser to sense a parameter of the ambient environment, wherein the controller is programmed to determine a duty cycle that is the same for the first heater and the second heater and having an "on" state and an "off" state for each of the first heater and the second heater based on the sensed ambient parameter.

16. The refrigerated merchandiser of claim 15, wherein the duty cycle is a first duty cycle, wherein the controller is programmed to determine the first duty cycle based on a first ambient parameter value, and to determine a second duty cycle based on a second ambient parameter value, and wherein the second duty cycle is different from the first duty cycle.

17. The refrigerated merchandiser of claim 16, wherein at least one of the first duty cycle and the second duty cycle is defined such that the first heater and the second heater are in the "on" state for a first predetermined time, and in the "off" state for a second predetermined time that is shorter than the first predetermined time.

18. The refrigerated merchandiser of claim 16, wherein at least one of the first duty cycle and the second duty cycle is defined such that the first heater and the second heater are in the "on" state for a first predetermined time, and in the "off" state for a second predetermined time that is longer than the first predetermined time.

19. A method of operating a refrigerated merchandiser including a case defining a product display area and having a frame with a first heater and a second heater routed along the frame, and a door providing access to the product display area, the method comprising:

sensing a parameter of an ambient environment adjacent the case;

delivering a signal indicative of the sensed parameter to a controller;

selectively activating both the first heater and the second heater at the same time via the controller in response to the sensed parameter, the first heater having a first wattage output and the second heater having a second wattage output different from the first wattage output; and removing or inhibiting formation of condensation in response to activating the first and second heaters, wherein the controller is configured to dependently control the first heater and the second heater so that the first heater and the second heater are activated at the same time and deactivated at the same time.

20. The method of claim 19, further comprising determining a first duty cycle based on a first sensed ambient parameter value;

determining a second, different duty cycle based on a second ambient parameter value; and operating both the first heater and the second heater based on the first duty cycle or the second duty cycle.

* * * * *